US007283057B2

(12) United States Patent
Kim

(10) Patent No.: US 7,283,057 B2
(45) Date of Patent: Oct. 16, 2007

(54) FIRE ALARM SPREADING SYSTEM AND METHOD

(75) Inventor: Jung-Hoon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 178 days.

(21) Appl. No.: 11/029,360

(22) Filed: Jan. 6, 2005

(65) Prior Publication Data

US 2006/0061478 A1 Mar. 23, 2006

(30) Foreign Application Priority Data

Sep. 23, 2004 (KR) ..... 10-2004-0076648

(51) Int. Cl.
*G08B 17/10* (2006.01)

(52) U.S. Cl. ..... 340/628; 340/629; 700/258; 348/143

(58) Field of Classification Search ..... 340/628–630, 340/584–600; 700/245–264, 258–9; 348/61, 348/82, 135, 143, 148
See application file for complete search history.

(56) References Cited

U.S. PATENT DOCUMENTS

| | | | | |
|---|---|---|---|---|
| 4,777,416 | A * | 10/1988 | George et al. | 318/568.12 |
| 5,155,474 | A * | 10/1992 | Park et al. | 340/691.5 |
| 5,440,216 | A | 8/1995 | Kim | |
| 5,446,445 | A * | 8/1995 | Bloomfield et al. | 340/521 |
| 5,646,494 | A | 7/1997 | Han | |
| 6,763,282 | B2 * | 7/2004 | Glenn et al. | 700/245 |
| 2004/0073337 | A1 * | 4/2004 | McKee et al. | 700/245 |
| 2005/0068175 | A1 * | 3/2005 | Faulkner et al. | 340/541 |
| 2006/0007005 | A1 * | 1/2006 | Yui et al. | 340/573.4 |

FOREIGN PATENT DOCUMENTS

| | | | |
|---|---|---|---|
| JP | 7-164374 | | 6/1995 |
| JP | 2000-126324 | | 5/2000 |
| JP | 2002092761 | * | 3/2002 |
| KR | 10-2004-11010 | | 2/2004 |
| KR | 10-2004-11024 | | 2/2004 |
| WO | 02/073947 | | 9/2002 |

OTHER PUBLICATIONS

English language Abstract of Korean 10-2004-11024.
English language Abstract of Korean 10-2004-11010.
English Language Abstract of JP 2000-126324.
English Language Abstract of JP 7-164374, 2000.

* cited by examiner

*Primary Examiner*—Jeffery Hofsass
*Assistant Examiner*—Hongmin Fan
(74) *Attorney, Agent, or Firm*—Greenblum & Bernstein, P.L.C.

(57) ABSTRACT

A fire alarm spreading system includes a robot cleaner for generating fire alarm data when smoke is detected while patrolling a specific area and transmitting the fire alarm data; and a wireless communication base station for receiving the fire alarm data transmitted from the robot cleaner and transmitting the received fire alarm data to a pre-set fire center. When a fire breaks out in a specific space (e.g., in a house), the mobile robot such as the robot cleaner detects the fire (smoke) and generates a fire alarm tone. Thus, the fire can be quickly detected and people can evacuate from the fire-generated area, reducing casualty.

16 Claims, 5 Drawing Sheets

FIRE ALARM SPREADING SYSTEM AND METHOD

BACKGROUND OF THE INVENTION

1. Field of the Invention

The present invention relates to a fire alarm spreading system and method, and more particularly, to a fire alarm spreading system and method using a mobile robot such as a robot cleaner.

2. Description of the Conventional Art

In general, a mobile robot is a device for automatically cleaning an area by sucking foreign substances such as dust from the floor while moving in a room (e.g., a living room or an inner room, etc.) of a house by itself without user's manipulation.

In cleaning, the robot cleaner discriminates a distance from itself to an obstacle such as furniture, office supplies or a wall in a cleaning area through a distance sensor and selectively controls a motor for rotating its left wheel and a motor for rotating its right wheel according to the discriminated distance to thereby change its direction and automatically clean the cleaning area. Herein, the robot cleaner performs the cleaning operation while traveling in the cleaning area through map information stored in an internal storage unit.

For example, the robot cleaner includes a gyro sensor for sensing a direction of the robot cleaner, an encoder for determining a traveling distance by sensing the number of times of rotation of the wheel of the robot cleaner; an ultrasonic sensor for sensing a distance between the robot cleaner, a target; and an infrared ray sensor for sensing an obstacle, and other numerous sensors.

However, the conventional robot cleaner has shortcomings in that because numerous high-priced sensors are installed to perform cleaning by precisely traveling along a pre-set cleaning path, its internal structure is complicated and fabrication cost increases.

In an effort to solve such a problem, a robot cleaner has been developed to perform cleaning by traveling along an arbitrary cleaning path in a random manner.

A traveling device of the robot cleaner in accordance with a conventional art will now be described.

FIG. 1 is a block diagram showing the construction of the traveling device of a robot cleaner in accordance with a conventional art.

As shown in FIG. 1, the traveling device of a conventional robot cleaner includes: an obstacle detecting unit 1 for detecting an obstacle based on an impact amount generated when a robot cleaner going straight ahead in a specific area collides with the obstacle and generating an obstacle detect signal; a controller for stopping traveling of the robot cleaner based on the obstacle detect signal generated by the obstacle detecting unit 1, generating a random angle randomly, and generating a control signal for rotating the robot cleaner according to the random angle; a left motor driving unit 3 for rotating a left motor ($M_L$) 5 of the robot cleaner at a certain speed according to the control signal of the controller 2; and a right motor driving unit 4 for rotating a right motor ($M_R$) 6 of the robot cleaner at a certain speed according to the control signal of the controller 2.

FIG. 2 is a flow chart of a method for traveling a robot cleaner in accordance with the conventional art.

First, when a user inputs a cleaning command signal (step S1), the controller 2 generates a control signal to make the rotation speed of the left motor 5 and the right motor 6 equal in order to making the robot cleaner go straight ahead, and simultaneously outputs the control signal to the left motor driving unit 3 an the right motor driving unit 4 (step S2).

The left motor driving unit 3 rotates the left motor 5 according to the control signal of the controller. At this time, the right motor driving unit 4 rotates the right motor 6 according to the control signal of the controller 2. Namely, as the left and right motors 5 and 6 are simultaneously rotated, the robot cleaner goes straight ahead.

The obstacle detecting unit detects an obstacle based on an amount of impact generated when the robot cleaner collides with the obstacle, generates an obstacle detect signal, and applies the obstacle detect signal to the controller 2 (step S3). If the obstacle detect signal is not generated, the robot cleaner continuously performs cleaning operation.

The controller 2 stops traveling of the robot cleaner according to the obstacle detect signal, generates a random angle randomly (step S4), generates a control signal for rotating the robot cleaner according to the random angle, and then outputs the generated control signal to the left and right motor driving units 3 and 4.

The left motor driving unit 3 rotates the left motor 5 according to the control signal of the controller 2, and the right motor driving unit 4 rotates the right motor 6 according to the control signal of the controller. In other words, by controlling the rotation speed of the left motor 5 and the rotation speed of the right motor 6 differently, the direction of the robot cleaner can be changed to a random angle (step S5).

Thereafter, when the robot cleaner is rotated as much as the random angle, the controller allows the robot cleaner to go straight ahead (step S6). When the cleaning operation of the robot cleaner is completed, the controller terminates the cleaning operation (step S7). If the cleaning operation of the robot cleaner is not completed, the controller allows the robot cleaner to repeatedly perform the cleaning operation.

Meanwhile, recently, a robot cleaner having a multimedia function as well as the cleaning function has been developed. Namely, the robot cleaner can download various multimedia contents by connecting to an Internet network or to a wireless communication network and reproduces the downloaded contents. In addition, the robot cleaner also has a function of photographing a cleaning area with a camera and transmitting the photographed image to an external user terminal.

U.S. Pat. Nos. 5,440,216 and 5,646,494 also disclose a robot cleaner.

SUMMARY OF THE INVENTION

Therefore, one object of the present invention is to provide a fire alarm spreading system and method, by which when a file breaks out in a specific space (e.g., a house), a mobile robot such as a robot cleaner detects the fire (smoke) and generates a fire alarm sound that people can evacuate from the fire-generated area, thereby reducing casualty.

Another object of the present invention is to provide a fire alarm spreading system and method, by which, when a fire breaks out in a specific space (e.g., a house), a mobile robot such as a robot cleaner detects the first (smoke) and a temperature, photographs the fire-generated area, and transmits an image signal of the photographed fire-generated area to a fire station (fire defense headquarters, fire department or a fire center) through a wireless communication network or a network so that the first can be quickly suppressed.

To achieve these and other advantages and in accordance with the purpose of the present invention, as embodied and broadly described herein, there is provided a fire alarm spreading system including: a robot cleaner for generating fire alarm data when smoke is detected while patrolling a specific area and transmitting the fire alarm data; and a wireless communication base station for receiving the fire alarm data transmitted from the robot cleaner and transmitting the received fire alarm data to a pre-set fire center.

To achieve the above objects, there is also provided a fire alarm spreading system including: a smoke detector installed at a robot cleaner for cleaning a pre-set cleaning area and generating a smoke detect signal when smoke is detected while patrolling a pre-set specific area; a microcomputer installed at the robot cleaner, generating fire alarm data for spreading fire alarm when the smoke detect signal is received from the smoke detector, generating a first control signal for generating a fire alarm tone, and generating a second control signal for photographing a peripheral area; a fire alarm tone generator installed at the robot cleaner and generating an alarm tone according to the first control signal; a camera installed at the robot cleaner, photographing the peripheral area according to the second control signal and outputting an image signal of the photographed peripheral area; a wireless communicating unit installed at the robot cleaner and transmitting the fire alarm data; and a wireless communication base station for receiving the fire alarm data transmitted fro the wireless communicating unit of the robot cleaner and transmitting the received fire alarm data to a pre-set fire center.

To achieve the above object, there is also provided a fire alarm spreading method including: detecting smoke through a smoke detector of a robot cleaner in a specific area; generating a fire alarm tone when smoke is detected; generating fire alarm data when smoke is detected, and transmitting the fire alarm data to a fire center through a wireless communication network; sensing an ambient temperature through a temperature sensor of the robot cleaner and recognizing a fire-generated area based on the sensed temperature value and a reference temperature value; photographing the recognized fire-generated area through a camera of the robot cleaner; and transmitting an image signal of the photographed fire-generated area to the fire center through the wireless communication network on a real time basis.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

A system and method for quickly spreading a fire alarm by using a mobile robot such as a robot cleaner in accordance with preferred embodiments of the present invention will now be described with reference to FIGS. 3 to 6.

Figure 1:
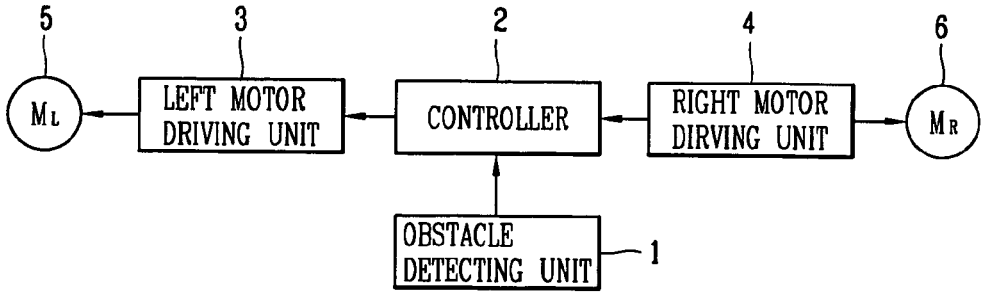
FIG. 1 CONVENTIONAL ART
FIG. 1 is a block diagram showing the construction of a traveling apparatus of a robot cleaner in accordance with a conventional art.
Figure 2:
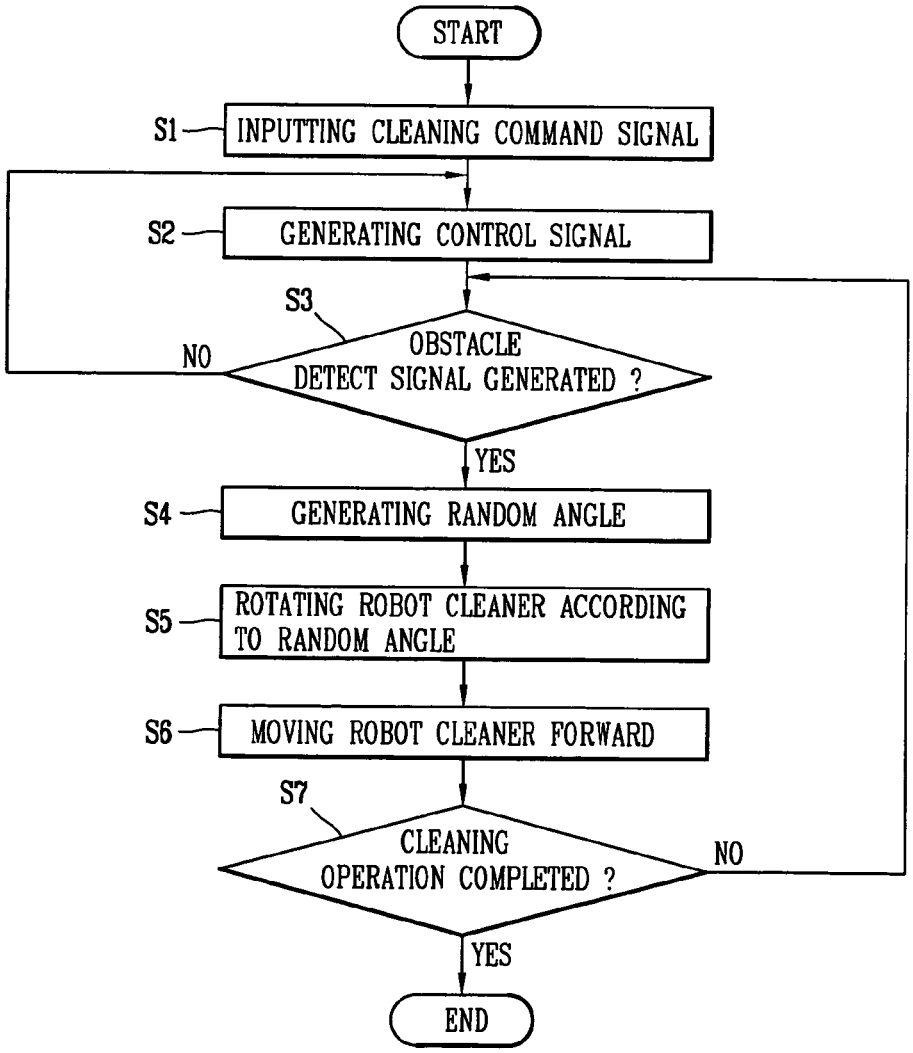
FIG. 2 CONVENTIONAL ART
FIG. 2 is a flow chart of a traveling method of the robot cleaner in accordance with the conventional art.
Figure 3:
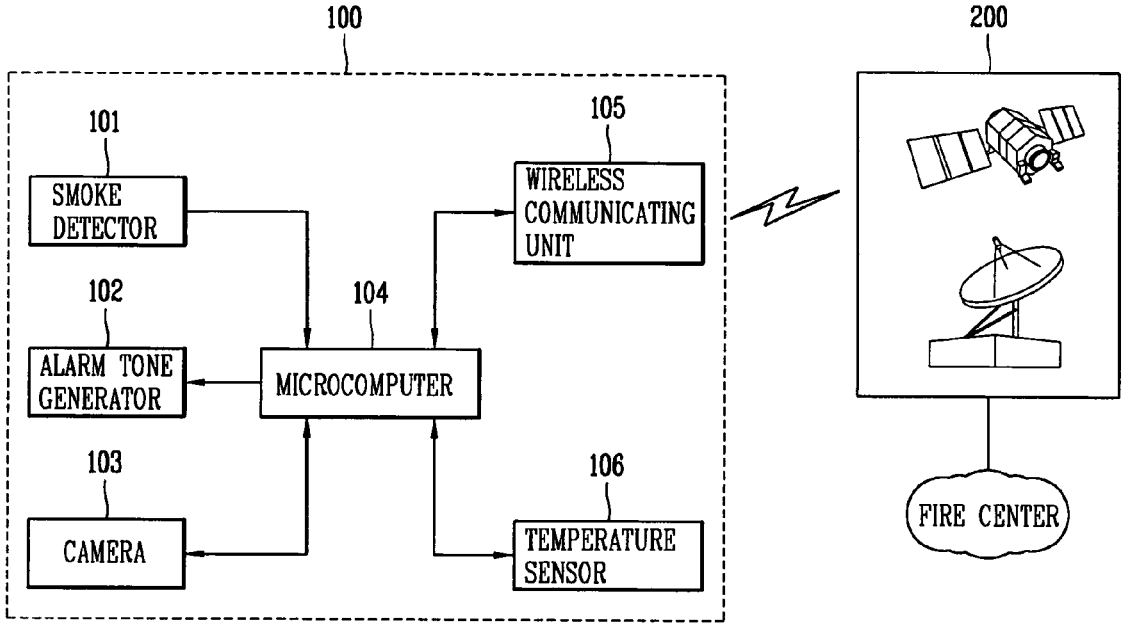
FIG. 3 is a block diagram showing the construction of a fire alarm spreading system using a robot cleaner in accordance with a first embodiment of the present invention.

FIG. 3 is a block diagram showing the construction of a fire alarm spreading system using a robot cleaner in accordance with a first embodiment of the present invention.

As shown in FIG. 3, a fire alarm spreading system using a robot cleaner in accordance with the first embodiment of the present invention includes: a robot cleaner 100 for recognizing generation of a fire when smoke is detected while patrolling a specific area such as a room of a house at certain time intervals, generating fire alarm data, and transmitting the fire alarm data; and a wireless communication base station 200 for receiving the fire alarm data transmitted from the robot cleaner 100 and transmitting the received fire alarm data to a pre-set fire center.

Herein, the fire alarm data includes address information (e.g., an address of a house where the robot cleaner is installed). In addition, a phone number (e.g., '911' in case of the United States) of the fire center for transmitting the fire alarm data when fire breaks out is previously stored in a storing unit (not shown) of the robot cleaner 100.

The robot cleaner's cleaning function and the function of photographing a cleaning area and transmitting the photographed image to a mobile terminal of a user fall to the conventional art, so a description of which is thus omitted.

The robot cleaner 100 includes a smoke detector 101 for generating a smoke detect signal when smoke is detected while the robot cleaner 100 is patrolling a dangerous area including the cleaning area; a microcomputer 104 for generating fire alarm data for spreading a fire alarm when the smoke detect signal is received from the smoke detector 101 and generating a first control signal for generating a fire alarm tone and a second control signal for photographing a peripheral area (i.e., the area around the smoke detector; a fire alarm tone generator 102 for generating an alarm tone according to the first control signal; a camera 103 for photographing the peripheral area according to the second control signal and outputting an image signal of the photographed peripheral area; and a wireless communicating unit 105 for transmitting the fire alarm data to the fire center through a wireless communication base station 200. Herein, preferably, the microcomputer 104 generates a second control signal for photographing the peripheral area of the smoke detector that has detected smoke.

Preferably, the wireless communicating unit 105 converts the fire alarm data into a mobile communication protocol and transmits the converted mobile communication protocol (fire alarm data) to the wireless communication base station 200. The microcomputer 104 includes a storing unit (not shown) for previously storing a phone number for transmitting the fire alarm data.

The robot cleaner 100 additionally includes a temperature sensor 106 for sensing an ambient temperature of each direction (e.g., an ambient temperature is sensed whenever the robot cleaner is rotated 45°) while rotating 360° under the control of the microcomputer 104 when smoke is detected, whereby only a fire-generated area can be concentratively photographed without a necessity of photographing the entire peripheral area.

For example, if the smoke detect signal is received, the microcomputer 104 detects a temperature of each direction through the temperature sensor 106 while rotating the robot cleaner 100, and if a temperature value detected in a specific direction, among the detected temperature values, is greater than a reference temperature value (e.g., 200°), the microcomputer 104 recognizes the specific direction as a fire-generated area and outputs a control signal for photographing the recognized fire-generated area to the camera 103.

Then, the camera 103 photographs the fire-generated area according to the control signal and outputs an image signal of the photographed fire-generated area to the microcomputer 104.

Then, the microcomputer 104 outputs the image signal of the fire-generated area to the wireless communicating unit 105 and the wireless communicating unit 105 transmits the image signal of the fire-generated area to the fire center through the wireless communication base station 200.

The technique of rotating the robot cleaner 100 by 360° and rotating the robot cleaner in the specific direction under the control of the microcomputer 104 can be easily performed by an ordinary person skilled in the art, so a description of which is thus omitted.

The operation of the fire alarm spreading system using the robot cleaner in accordance with the first embodiment of the present invention will be described in detail with reference to FIG. 4.

Figure 4:
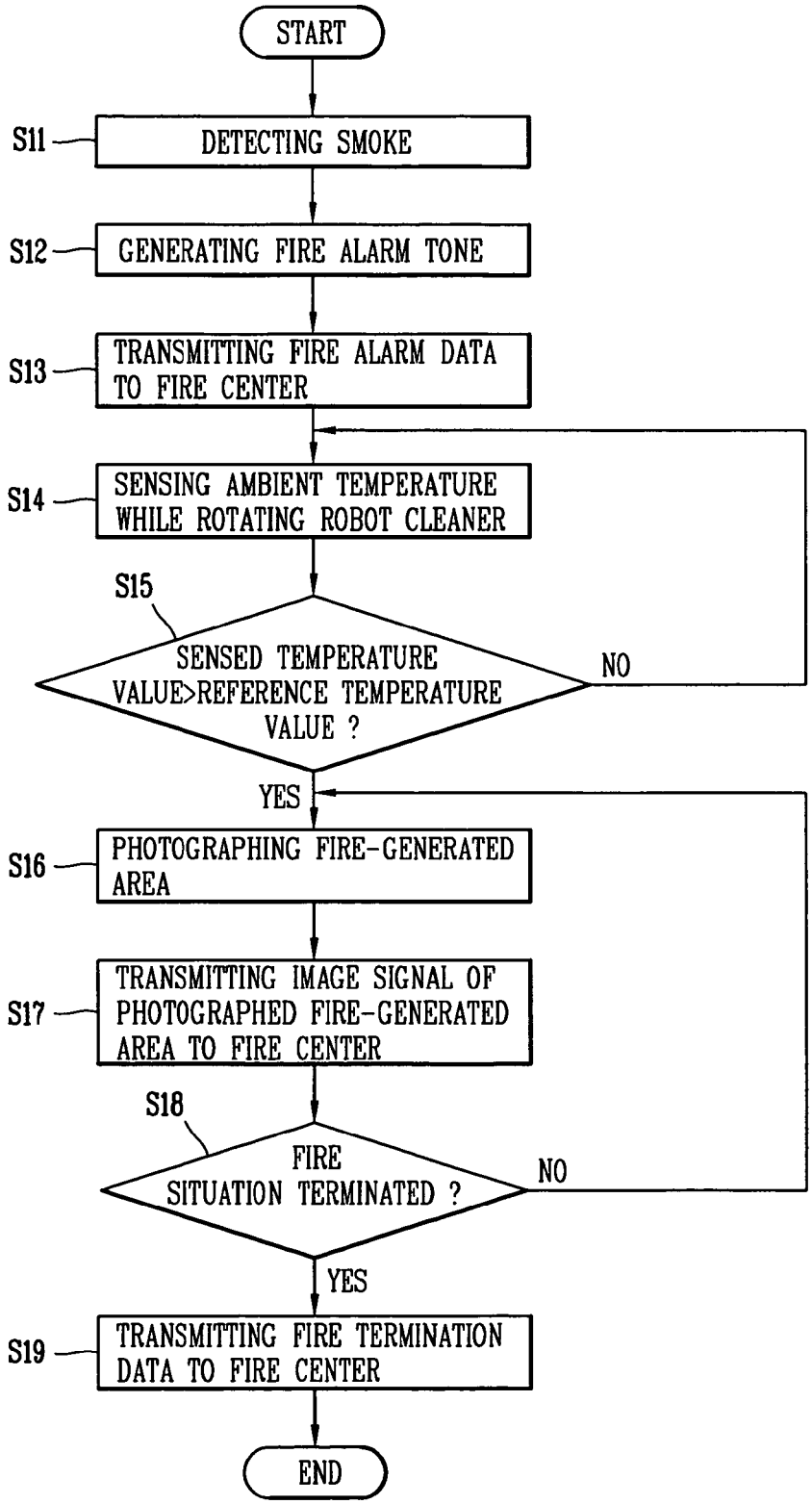
FIG. 4 is a flow chart of the fire alarm spreading method using a robot cleaner in accordance with the first embodiment of the present invention.

FIG. 4 is a flow chart of the fire alarm spreading method using a robot cleaner in accordance with the first embodiment of the present invention.

First, when smoke is generated while the robot cleaner 100 is patrolling (e.g., patrolling a pre-set cleaning area and a dangerous zone) an indoor place (e.g., a living room) of a house, the smoke detector 101 installed at the robot cleaner 100 detects the smoke. In addition, when smoke is detected, the smoke detector 101 generates a smoke detect signal and outputs the generated smoke detect signal to the microcomputer 104 (step S11).

When the smoke detect signal is received, the microcomputer 104 generates a first control signal for generating a fire alarm tone and outputs the first control signal to the alarm tone generator 102. Upon receiving the first control signal, the alarm tone generator 102 generates a fire alarm tone so that people around there can quickly evacuated therefrom (step S12).

In addition, when the smoke detect signal is received, the microcomputer 104 generates a fire alarm data and outputs the generated fire alarm data to the wireless communicating unit 105. Then, in order to report the fire, the wireless communicating unit 105 transmits the fire alarm data to the fire center through wireless communication network (e.g., the wireless communication base station (200)) (step S13).

Thereafter, the microcomputer 104 rotates the robot cleaner 100 360°, and whenever the robot cleaner 100 is rotated in each direction, that is, for example, by 45°, the microcomputer 104 detects an ambient temperature through the temperature sensor 106 (step S14). Preferably, the microcomputer 104 moves the robot cleaner 100 to the smoke detector 101 and then rotates the robot cleaner 100 by 360°.

If a temperature value detected in a specific area (e.g., when the robot cleaner is rotated by 90°), among temperature values detected through the temperature sensor 106, is greater than a reference temperature value (e.g., 200°), the microcomputer 104 recognizes the specific direction as a fire-generated area and outputs a second control signal for photographing the recognized fire-generated area to the camera 103 (step S15).

The camera 103 photographs the fire-generated area according to the second control signal and outputs an image signal of the photographed fire-generated area to the microcomputer 104 (step S16).

The microcomputer 104 outputs the image signal of the fire-generated area to the wireless communicating unit 105 and the wireless communicating unit 105 transmits the image signal of the fire-generated area to the fire center through the wireless communication base station 200 on a real time basis (step S17).

Thereafter, when smoke is not detected by the smoke detector 101, the robot cleaner 100 determines that the fire situation has been terminated and data informing about termination of the fire (fire termination data) to the fire center through the wireless communication network (steps S18 and S19).

If, however, smoke is continuously detected by the smoke detector 101, the robot cleaner 100 determines that fire is ongoing, continuously photographs the fire-generated area and transmits an image signal of the photographed fire-generated area to the fire center through the wireless communication network.

Figure 5:
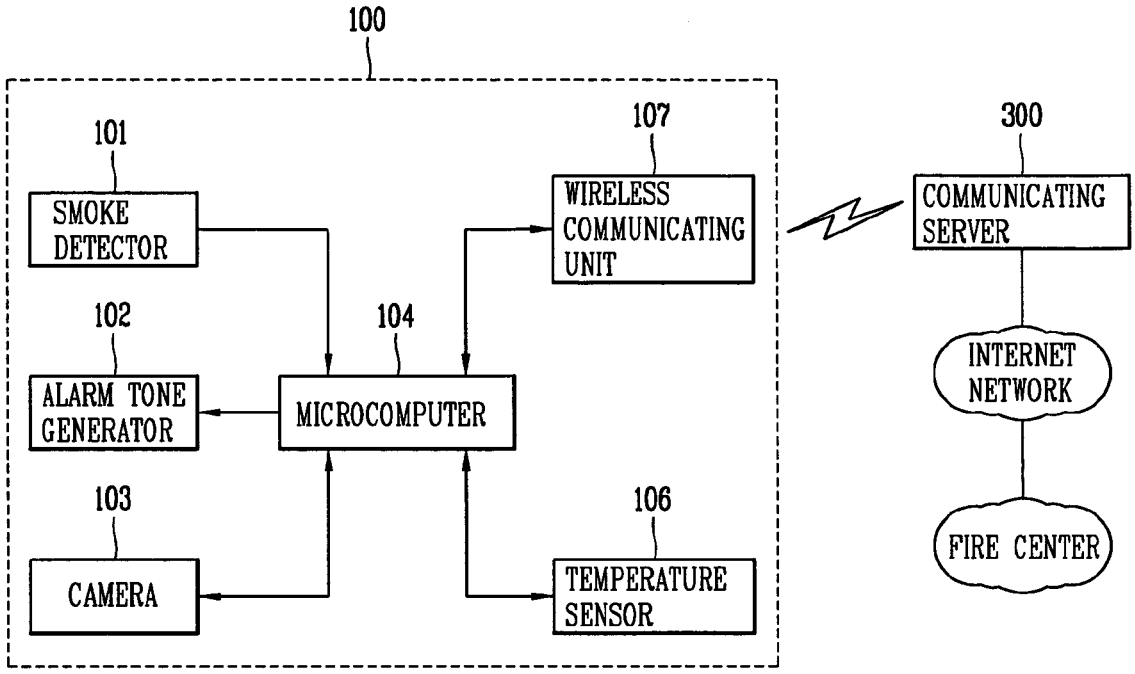
FIG. 5 is a block diagram showing the construction of a fire alarm spreading system using a robot cleaner in accordance with a second embodiment of the present invention.

FIG. 5 is a block diagram showing the construction of a fire alarm spreading system using a robot cleaner in accordance with a second embodiment of the present invention.

As shown in FIG. 5, a first alarm spreading system using a robot cleaner in accordance with the second embodiment of the present invention includes: a robot cleaner 100 for recognizing generation of a fire when smoke is detected while patrolling a specific area such as a room of a house at certain time intervals, generating fire alarm data, and transmitting the fire alarm data; and a communicating server 300 for receiving the fire alarm data transmitted from the robot cleaner 100 and transmitting the received fire alarm data to a pre-set fire center through an Internet network.

The communicating server 300 is installed at a charging station for charging power of the robot cleaner 100 and receives power from the charging station.

The fire alarm spreading system using the robot cleaner in accordance with the second embodiment transmits the fire alarm data and an image signal through the communicating server 300. That is, the construction of the fire alarm spreading system in accordance with the second embodiment is the same as in the first embodiment of the present invention, except for the communicating server 200 and the Internet network, so a detailed description of which is thus omitted.

The communicating server 300 transmits the fire alarm data received from a wireless communicating unit 107 to an external fire center through the Internet network.

The wireless communicating unit 107 can be formed as an RF (Radio Frequency) transceiver. The RF transceiver converts the fire alarm data into RF fire alarm data and transmits the converted RF fire alarm data to the communicating server 300. Preferably, the communicating server 300 includes a CPU (Central Processing Unit) (not shown) for converting the RF fire alarm data into a transfer protocol for network communication.

The wireless communicating unit 107 can be also formed as a wireless LAN. The wireless LAN converts the fire alarm data into wireless fire alarm data and transmits the converted wireless fire alarm data to the communicating server 300.

Preferably, the communicating sever 300 includes a CPU for converting the wireless fire alarm data into a transfer protocol for network communication.

The wireless communicating unit 107 can be also formed as a Bluetooth module. The Bluetooth module converts the fire alarm data into a Bluetooth fire alarm data and transmits the converted Bluetooth fire alarm data to the communicating server 300. Preferably, the communicating server 300 includes a CPU for converting the Bluetooth fire alarm data into a transfer protocol for network communication.

The operation of the fire alarm spreading system using the robot cleaner in accordance with the second embodiment of the present invention will now be described with reference to FIG. 6.

Figure 6:
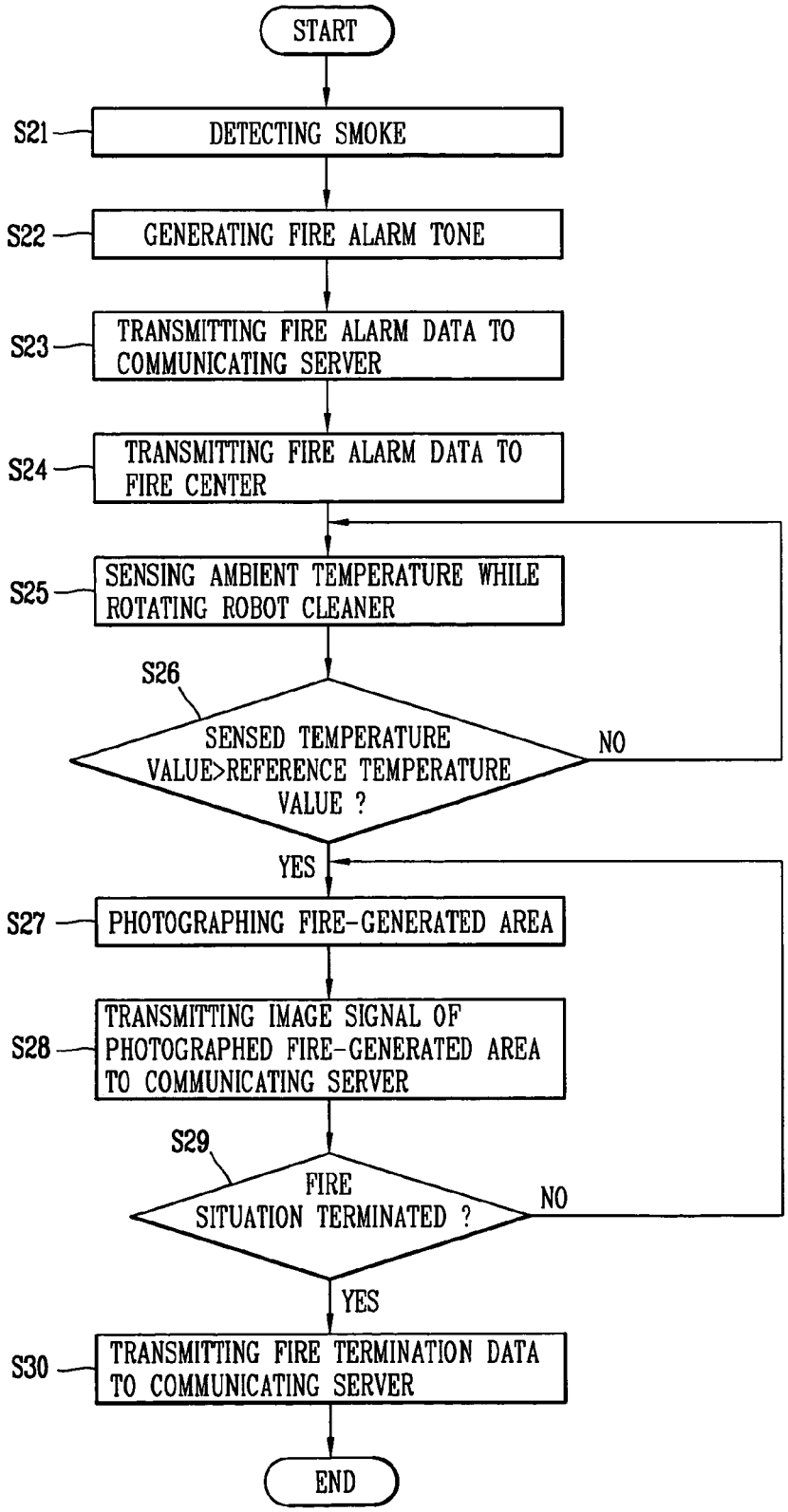
FIG. 6 is a flow chart of the fire alarm spreading method using a robot cleaner in accordance with the second embodiment of the present invention.

FIG. 6 is a flow chart of the fire alarm spreading method using a robot cleaner in accordance with the second embodiment of the present invention;

First, when smoke is generated while the robot cleaner 100 is patrolling an indoor place of a house, the smoke detector 101 installed at the robot cleaner 100 detects the smoke. In addition, when smoke is detected, the smoke detector 101 generates a smoke detect signal and outputs the generated smoke detect signal to the microcomputer 104 (step S21).

When the smoke detect signal is received, the microcomputer 104 generates a first control signal for generating a fire alarm tone and outputs the first control signal to the alarm tone generator 102. Upon receiving the first control signal, the alarm tone generator 102 generates a fire alarm tone so that people around there can quickly evacuate therefrom (step S22).

In addition, when the smoke detect signal is received, the microcomputer 104 generates a fire alarm data and outputs the generated fire alarm data to the wireless communicating unit 107.

Then, in order to report the fire, the wireless communicating unit 107 transmits the fire alarm data to the communicating server 300 (step S23). The fire alarm data can be converted into RF fire alarm data, into bluetooth fire alarm data or into radio fire alarm data.

And then, the communicating server 300 transmits the fire alarm data to the fire center through the Internet network to report the fire (step S24).

Thereafter, the microcomputer 104 rotates the robot cleaner 100 360° and detects an ambient temperature in each direction through the temperature sensor 106 (step S25).

If a temperature value detected in a specific area, among temperature values detected through the temperature sensor 106, is greater than a reference temperature value (e.g., 200°), the microcomputer 104 recognizes the specific direction as a fire-generated area and outputs a second control signal for photographing the recognized fire-generated area to the camera 103 (step S26).

The camera 103 photographs the fire-generated area according to the second control signal and outputs an image signal of the photographed fire-generated area to the microcomputer 104 (step S27).

The microcomputer 104 outputs the image signal of the fire-generated area to the wireless communicating unit 107 and the wireless communicating unit 107 transmits the image signal of the fire-generated area to the communicating server 30 (step S28).

The communicating server 300 converts the image signal into a transfer protocol for network communication on a real time basis, and then transmits the converted transfer protocol to the fire center through the Internet network.

Thereafter, when smoke is not detected by the smoke detector 101, the robot cleaner 100 determines that the fire situation has been terminated and data informing about termination of the fire (fire termination data) to the fire center through the communicating server 300 and the Internet network (steps S29 and S30).

If, however, smoke is continuously detected by the smoke detector 101, the robot cleaner 100 determines that fire is ongoing, continuously photographs the fire-generated area and transmits an image signal of the photographed fire-generated area to the fire center through the communicating server 300 and the Internet network.

As so far described, the fire alarm spreading system and method of the present invention have the following advantages.

That is, for example, when a fire breaks out in a specific space (e.g., in a house), the mobile robot such as the robot cleaner detects the fire (smoke) and generates a fire alarm tone. Thus, the fire can be quickly detected and people can evacuate from the fire-generated area, reducing casualty.

In addition, when a fire breaks out in a specific space (e.g., in a house), the mobile robot such as the robot cleaner detects the fire (smoke) and a temperature, photographs the fire-generated area, and transmits an image signal of the photographed fire-generated area to the fire center through a wireless communication network or an external network on a real time basis. Thus, the fire center can suppress the fire promptly.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A fire alarm spreading system, comprising:

a robot cleaner which generates fire alarm data when smoke is detected while patrolling a specific area and transmits the fire alarm data, the robot cleaner comprising a microcomputer which searches for and recognizes a fire in response to detecting the smoke and controls a camera to photograph an area where the recognized fire is located;

a temperature sensor which senses an ambient temperature while rotating under the control of the microcomputer when smoke is detected; and a wireless communication base station which receives the fire alarm data transmitted from the robot cleaner and transmits the received fire alarm data to a pre-set fire center, wherein the microcomputer searches for the fire by rotating the robot cleaner and measuring an ambient temperature of a plurality of directions with the temperature sensor, recognizes the fire by determining that an ambient temperature is greater than a reference temperature value, and controls the camera to photograph an area where the ambient temperature is greater than the reference temperature value.

2. The system of claim 1, wherein the fire alarm data includes address information of a place where the robot cleaner is located.

3. The system of claim 2, wherein the robot cleaner comprises:

a smoke detector which generates a smoke detect signal when smoke is detected;

a fire alarm tone generator which generates an alarm tone;

a camera which photographs an area and outputs an image signal of the photographed area; and a wireless communicating unit which transmits the fire alarm data to the fire center through the wireless communication base station, wherein the microcomputer generates the fire alarm data when it receives the smoke detect signal and generates a first control signal and a second control signal, the fire alarm tone generator generates the alarm tone when it receives the first control signal from the microcomputer, the camera photographs the area when it receives the second control signal from the microcomputer.

4. The system of claim 3, wherein the wireless communicating unit converts the fire alarm data into a mobile communication protocol and transmits the converted mobile communication protocol to the wireless communication base station.

5. The system of claim 3, wherein the microcomputer includes a storing unit which pre-stores a phone number for transmitting the fire alarm data.

6. The system of claim 1, wherein the camera outputs an image signal of the photographed area to the microcomputer.

7. The system of claim 6, wherein the microcomputer outputs the image signal to the wireless communicating unit and the wireless communicating unit transmits the image signal to the fire center through the wireless communication base station.

8. The system of claim 3, wherein the wireless communicating unit is an RF (Radio Frequency) transmitter.

9. The system of claim 3, wherein the wireless communicating unit is a wireless LAN.

10. The system of claim 3, wherein the wireless communicating unit is a Bluetooth module.

11. The system of claim 1, further comprising:

a communicating server which transmits the fire alarm data to the fire center through an Internet network.

12. The system of claim 11, wherein the communicating server is installed at a charging station which charges power of the robot cleaner and receives power from the charging station.

13. A fire alarm spreading system, comprising:

a smoke detector installed at a robot cleaner which cleans a pre-set cleaning area and generates a smoke detect signal when smoke is detected while patrolling a pre-set specific area;

a microcomputer installed at the robot cleaner which searches for and recognizes a fire and generates fire alarm data for spreading a fire alarm when the smoke detect signal is received from the smoke detector, generates a first control signal for generating a fire alarm tone, and generates a second control signal for photographing an area;

a fire alarm tone generator installed at the robot cleaner which generates an alarm tone according to the first control signal;

a camera installed at the robot cleaner which photographs the area according to the second control signal and outputs an image signal of the photographed area;

a wireless communicating unit installed at the robot cleaner which transmits the fire alarm data;

a wireless communication base station which receives the fire alarm data transmitted from the wireless communicating unit of the robot cleaner and transmits the received fire alarm data to a pre-set fire center; and a temperature sensor which senses an ambient temperature while rotating under the control of the microcomputer when smoke is detected, wherein the microcomputer searches for the fire by rotating the robot cleaner and measuring an ambient temperature of a plurality of directions with the temperature sensor, recognizes the fire by determining that an ambient temperature is greater than a reference temperature value, and controls the camera to photograph an area where the ambient temperature is greater than the reference temperature value, the camera outputs an image signal of the photographed area to the microcomputer, the microcomputer outputs the image signal to the wireless communicating unit, and the wireless communicating unit transmits the image signal to the fire center through the wireless communication base station.

14. A fire alarm spreading method, comprising:

generating fire alarm data by a robot cleaner when smoke is detected while the robot cleaner patrols a specific area;

searching for a fire in response to detecting the smoke by rotating the robot cleaner and measuring an ambient temperature of a plurality of directions with a temperature sensor;

recognizing the fire by determining that an ambient temperature is greater than a reference temperature value;

controlling a camera to photograph an area where the ambient temperature is greater than the reference temperature value;

transmitting the fire alarm data by the robot cleaner;

receiving by a wireless communication base station the fire alarm data transmitted by the robot cleaner; and transmitting the received fire alarm data to a pre-set fire center.

15. The method of claim 14, further comprising: previously storing a phone number of the fire center.

16. The method of claim 14, wherein the fire alarm data includes address information of a place where the robot cleaner is located.

* * * * *